US008089212B2

(12) United States Patent
Leonard et al.

(10) Patent No.: US 8,089,212 B2
(45) Date of Patent: Jan. 3, 2012

(54) LOWER TURN PER INCH (TPI) ELECTRODES IN CERAMIC METAL HALIDE (CMH) LAMPS

(75) Inventors: James A. Leonard, Shaker Heights, OH (US); Jianmin He, East Cleveland, OH (US); Szilard Nemeth, Pest (HU)

(73) Assignee: General Electric Company, Schenectady, NY (US)

( * ) Notice: Subject to any disclaimer, the term of this patent is extended or adjusted under 35 U.S.C. 154(b) by 295 days.

(21) Appl. No.: 12/188,532

(22) Filed: Aug. 8, 2008

(65) Prior Publication Data

US 2010/0033093 A1 Feb. 11, 2010

(51) Int. Cl.
*H01J 17/04* (2006.01)

(52) U.S. Cl. ..... 313/631; 313/623; 445/26

(58) Field of Classification Search ..... 313/623, 313/627–643, 567, 111–117, 25–27, 318.01–318.09; 439/615, 739; 445/24, 26, 29, 22
See application file for complete search history.

(56) References Cited

U.S. PATENT DOCUMENTS

| | | | | |
|---|---|---|---|---|
| 4,275,329 | A | 6/1981 | Fridrich et al. | |
| 5,424,609 | A | 6/1995 | Geven et al. | |
| 6,300,716 | B1 * | 10/2001 | Honda | 315/51 |
| 6,621,219 | B2 | 7/2002 | Allen et al. | |
| 6,713,962 | B2 | 5/2003 | Nohara et al. | |
| 6,856,079 | B1 * | 2/2005 | Zhu | 313/326 |
| 7,164,232 | B2 | 1/2006 | Brates et al. | |
| 2002/0084754 | A1 * | 7/2002 | Allen et al. | 313/623 |
| 2002/0145388 | A1 | 10/2002 | Kelly et al. | |
| 2004/0135511 | A1 * | 7/2004 | Lenz et al. | 313/631 |
| 2005/0264213 | A1 | 12/2005 | Dambacher et al. | |
| 2006/0001380 | A1 * | 1/2006 | Brates et al. | 313/624 |
| 2006/0226776 | A1 | 10/2006 | Chen et al. | |
| 2008/0132139 | A1 * | 6/2008 | Wei et al. | 445/26 |

FOREIGN PATENT DOCUMENTS

| | | | |
|---|---|---|---|
| EP | 1006560 | A | 6/2000 |
| EP | 1298705 | A | 4/2003 |
| JP | 2003059451 | A | 2/2003 |
| JP | 2008181844 | A | 8/2008 |

OTHER PUBLICATIONS

"Wolfram: Tungsten, Werkstoffeigenschaften und Anwendungen: Material Properties and Applications", Internet Citation, Apr. 8, 2009, pp. 1-36.

"Molybdan: Molybdenum, Werkstoffeigenschaften und Anwendungen: Material Properties and Applications", Internet Citation, Apr. 8 2009, pp. 1-32.

(Continued)

*Primary Examiner* — Nimeshkumar Patel
*Assistant Examiner* — Donald Raleigh
(74) *Attorney, Agent, or Firm* — Fay Sharpe LLP

(57) ABSTRACT

An electrode assembly for a discharge lamp, particularly a ceramic metal halide (CMH) lamp, having a ceramic body defining a discharge chamber and at least one leg having an opening therethrough. An electrode assembly is received at least in part in the body, preferably including a niobium mandrel, a molybdenum mandrel, and a molybdenum overwind received over the mandrel. A tungsten portion is then joined to the molybdenum composite. Adjacent turns of the overwind are spaced by a gap to facilitate receipt of an associated seal material on the overwind and the molybdenum mandrel. The gap is approximately 10% to 50% of the dimension between adjacent turns of the overwind relative to a diameter of the overwind.

17 Claims, 3 Drawing Sheets

OTHER PUBLICATIONS

"Tantal/ Niob Tantalum/ Niobium", Internet Citation, Apr. 8, 2009, pp. 1-28.

International Search Report issued in connection with corresponding PCT Application No. PCT/US2009/050812 on Mar. 30, 2010.

* cited by examiner

LOWER TURN PER INCH (TPI) ELECTRODES IN CERAMIC METAL HALIDE (CMH) LAMPS

BACKGROUND OF THE DISCLOSURE

This disclosure relates to an electrode assembly and method of forming same, as well as a discharge lamp such as a ceramic metal halide (CMH) lamp incorporating the electrode assembly.

If a leg temperature is high enough, seal corrosion is a leading failure mode for a discharge lamp such as a CMH lamp. In particular, material incompatibility is an issue associated with sealing a metal wire in a ceramic arc tube. That is, if the coefficients of thermal expansion of the respective materials are not sufficiently similar, then cracking ultimately results either in the seal glass or in the ceramic which leads to leakage of the dose and/or lamp failure. For example, it is known that alumina, a common ceramic used in CMH lamps, has a coefficient of thermal expansion that is a relatively close match with the coefficient of thermal expansion of niobium. This would tend to suggest using niobium as the sole material for the lead or electrode wire. However, niobium is incompatible with dose materials commonly used in CMH lamps. In fact, niobium will deteriorate in a matter of hours when exposed to the halide dose and ultimately leads to lamp failure. This suggests omitting niobium from use in the lead assembly. Tungsten and molybdenum on the other hand are more compatible with the dose materials. Tungsten and molybdenum suffer the problem of having coefficients of thermal expansion that are relatively incompatible with the alumina so that the mismatch in these materials leads to cracks in the ceramic material.

What has developed as a result of attempting to meet these competing concerns is a composite electrode assembly for a discharge lamp, and particularly for a CMH lamp, where the lead wire or electrode assembly is a composite of niobium at a first or outer end that is butt-welded to molybdenum as the intermediate or middle portion of the assembly and a tungsten electrode that is secured at the other end of the molybdenum. Moreover, the intermediate region of molybdenum is preferably comprised of two distinct portions, namely a molybdenum mandrel or shank that receives a molybdenum overwind, helix, or coil wrapped about it. In this manner, an opening through the leg is filled with an electrode assembly that is electrically conductive, thermally resistant, and resistant to the dose. The molybdenum mandrel with the molybdenum overwind has met these needs and the conventional thinking is that a tight winding was desired to fill the leg as completely as possible so that there is less of a region for the dose to condense or precipitate. That is, since a lamp leg is the equivalent of a cold spot, the leg has the drawback that in CMH lamps, for example, the dose condenses or precipitates in the leg. The first few milligrams of dose that are introduced into the discharge chamber ultimately end up in the leg, which becomes an expensive proposition. Thus, there has been a conventional desire to fill as much of the leg as possible with a thermally resistant, but electrically conductive, dose resistant material.

It is important to reduce the amount of seal voids in CMH lamps in order to abate the risk of decreased lamp life. Seal glass or frit seal is provided along at least a portion of the lead wire assembly to protect the niobium from the dose and also preferably extends inwardly along a portion of the molybdenum mandrel and helical overwind. It has been determined that voids are sometimes found in the structural arrangement and the seal voids are generally referred to as regions along the outer diameter of the molybdenum mandrel, and along an inner diameter region and between adjacent turns of the coil, that are devoid of frit seal (e.g., seal glass) or have pockets or openings, i.e., voids. The reason for formation of seal voids during the sealing process is not totally understood. However, a high variation of the amount of seal voids has been found within a single batch, as well as from one batch to another. Products whose lamp leg temperature is higher and/or have a higher amount of seal voids are more prone to a resulting leak. Although it has been determined that the frit may not fully enter into the molybdenum turns, conventional thinking was that it was undesirable to permit a gap between adjacent turns of the overwind.

A need exists therefore to reduce the extent of seal voids, and thereby leading to improving lamp life.

SUMMARY OF THE DISCLOSURE

The present disclosure increases a gap between molybdenum turns so as to reduce the probability of seal voids and decrease the amount of such voids.

An electrode assembly for a discharge lamp includes a first portion having a first coefficient of thermal expansion that is a good match to the ceramic but is subject to attack by a dose of the lamp. A second portion of the electrode assembly has a first end connected to the first portion, and a second end. The second portion of the electrode assembly is formed of a material different than the first portion, has a second coefficient of thermal expansion, and that is more resistant to attack by the dose than the first portion. A helical overwind is received over the second portion where adjacent turns of the overwind are spaced apart to facilitate receipt of associated seal material on the overwind and second portion. A tungsten electrode is attached to the second end of the second portion.

The helical overwind preferably has a gap greater than about ten percent (10%), and preferably between approximately ten percent (10%) to fifty percent (50%), of a first dimension measured between adjacent turns of the overwind relative to a diameter of the overwind.

The gap is more preferably between twenty to thirty (20-30%).

A CMH discharge lamp includes a ceramic body having a discharge chamber and at least one leg having an opening that communicates with the discharge chamber. An electrode assembly is received at least in part in the body where the electrode assembly includes a niobium mandrel, a molybdenum mandrel, a tungsten portion, and a molybdenum overwind received over the molybdenum mandrel, and wherein adjacent turns of the overwind are spaced by a gap. A frit seal extends over at least a portion of the niobium mandrel and over a limited portion of the overwind and the molybdenum mandrel.

A diameter of the molybdenum mandrel preferably ranges from approximately one to five times a diameter of the molybdenum overwind (1:1 to 5:1).

A frit seal extends over approximately one to two millimeters (1-2 mm) of the molybdenum mandrel.

A method of manufacturing an electrode assembly includes supplying a molybdenum mandrel and an overwind joined at a first end to a niobium mandrel and joined to a tungsten portion at a second end. The method further includes providing a gap between adjacent turns of the molybdenum mandrel to receive a seal frit on the turns and the molybdenum mandrel.

Preferably the gap is greater than five microns (5μ).

The method includes forming a gap that is greater than approximately 10%, and preferably ranges from between about ten percent (10%) to about fifty percent (50%), of a diameter of the overwind.

Preferably a ratio of a diameter of the molybdenum mandrel to a diameter of the overwind is greater than approximately 1:1, and preferably ranges from approximately 1:1 to 5:1.

A primary benefit resides in increased lamp life. Associated with increased lamp life is the reduction in cracks in the ceramic.

It is believed that an increased yield associated with manufacture will result from this lamp structure and the method of forming same.

Still another benefit resides in the ability to incorporate this improvement without substantially changing the remainder of the known manufacturing process.

Still other benefits and advantages will become more apparent from reading and understanding the following detailed description.

DETAILED DESCRIPTION OF THE PREFERRED EMBODIMENTS

Figure 1:
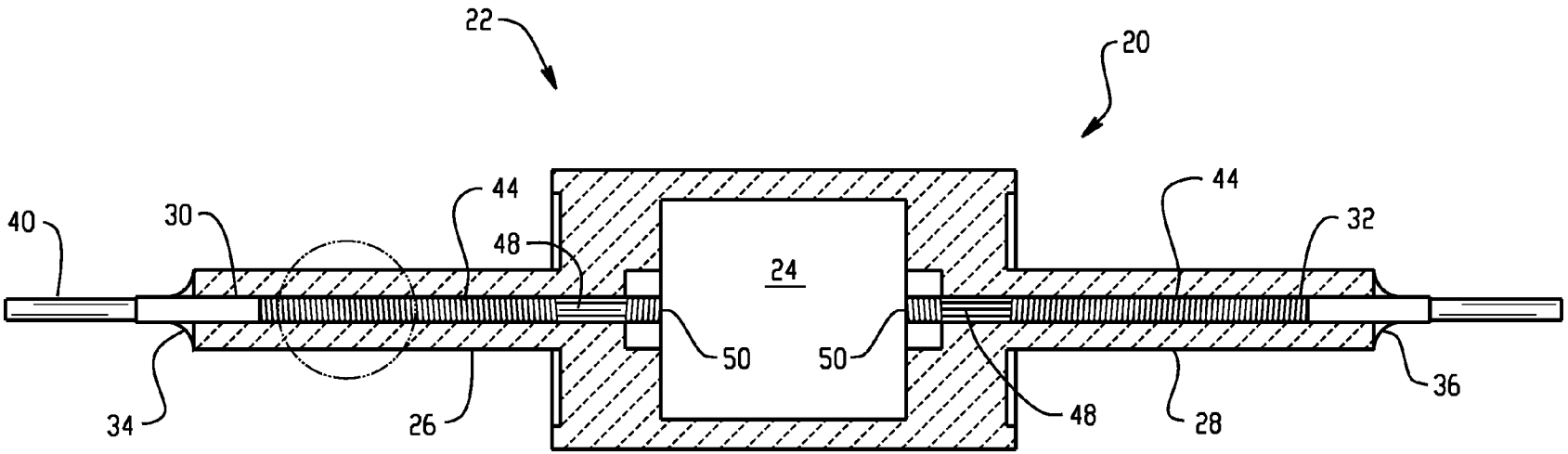
FIG. 1 is an elevational view of a lamp assembly shown partially in cross-section according to a preferred embodiment.

Turning first to FIG. 1, a lamp assembly or CMH lamp assembly 20 is illustrated having a hollow arc tube body or envelope 22. The body includes an interior cavity or arc discharge chamber 24. Extending in longitudinally opposite axial directions are first and second legs 26, 28. Each of the legs in the ceramic arc tube of this type include openings that receive electrode/lead wire assemblies 30, 32, respectively, that are connected to an external power source (not shown). In addition, seals 34, 36 are provided at each of the legs to hermetically seal the electrode assemblies relative to the legs. For example, a preferred seal is a frit seal that is typically provided along a niobium portion of the lead wire assembly, and partially extends over a molybdenum portion of the electrode assembly.

More particularly, the lead wire/electrode assemblies 30, 32 are preferably three-part assemblies including a first or outer lead portion 40 also referred to as a thermal expansion matching portion that preferably reduces or eliminates failures relating to stress from thermal expansion mismatch. The first lead portion 40 is preferably formed from niobium, although it will be appreciated that other materials that provide a desired thermal expansion match could be used without departing from the present disclosure. Rhenium, for example, is one such material but is generally a more expensive alternative. A second or intermediate component (FIG. 2) serves as a halide resistant material and one preferred structural arrangement is a molybdenum mandrel 42 with a molybdenum overwind 44. Of course, other materials may be used such as tungsten or cermet (ceramic metal) that have many of the same desirable properties of molybdenum and have been found to operate well in the high temperature environment of metal halide lamps. A third or inner lead portion is comprised of shank 48 and coil 50, both typically made of tungsten. Thus, the outer lead portion or niobium is joined to the intermediate component such as by welding, and likewise the second end of the molybdenum component is joined to the inner lead or electrode comprised of the tungsten shank and coil by a welding process.

Figure 2:
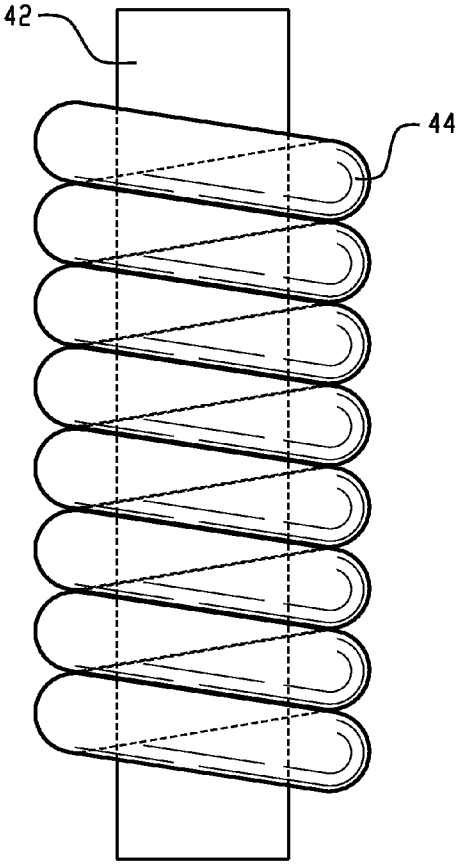
FIG. 2 is an enlarged view, partly in cross-section, of the encircled portion of FIG. 1 in accordance with a prior art arrangement.

FIG. 2 shows an enlarged encircled portion of one of the legs of the lamp. Particularly, it includes the intermediate component comprised of the molybdenum mandrel 42 and a molybdenum overwind 44. In this arrangement, adjacent turns of the overwind are intended to be tight, i.e., no space is desired between the coils of the overwind. As noted above, the reason for eliminating the space between the coils of the overwind was to assure that there was no gap between the adjacent turns, and thereby fill as much of the opening through the leg as possible so that the dose from the discharge chamber 24 did not precipitate or condense in this region. Likewise, the tight winding was particularly helpful from a thermal transfer standpoint. Rather than employing a single, larger diameter molybdenum wire or shank, which ultimately has too large a thermal loss if formed of a solid wire only, an elongated path is provided by the helical coil or overwind.

Figure 3:
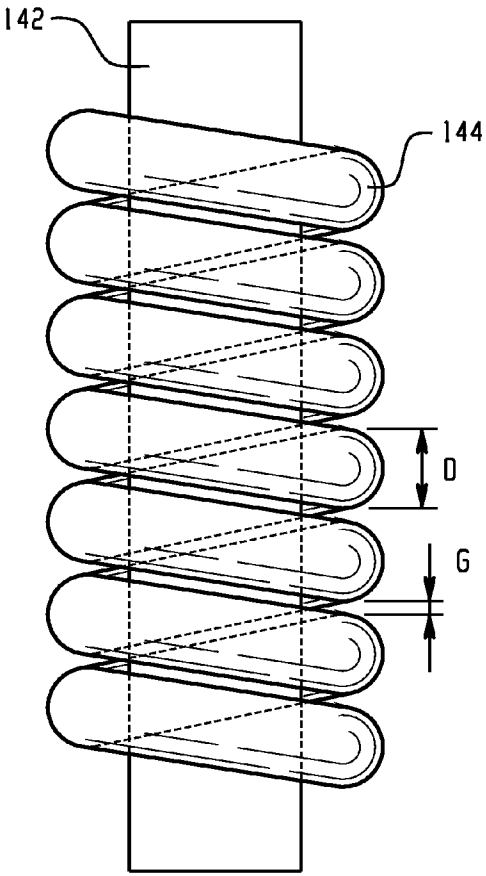
FIG. 3 is a view similar to FIG. 2 of the present disclosure.

In FIG. 3, the molybdenum mandrel is referred to as component 142, while the overwind is referred to as 144. The most significant difference, as noted in a comparison of FIGS. 2 and 3, is the provision of a gap G or small space between adjacent turns or coils of the overwind. A comparison of this gap dimension relative to a diameter D of the overwind coil provides a gap to diameter ratio (G/D) of approximately twenty percent (20%). Thus, although the absolute value of the gap dimension is important, the gap G is preferably greater than five microns (5μ), and preferably a G/D ratio greater than approximately 0.05 is also desired. The provision of the gap G creates greater space for the glass fit. By opening the space by a small amount, then the seal glass or seal frit can reach the interstitial space and provide an effective seal around a limited length of the molybdenum overwind and molybdenum mandrel. From a lamp performance standpoint, it would be ideal if the only gaps in the overwind were provided adjacent the niobium portion of the electrode assembly. However, the practicalities of assembly dictate that the gap G be provided throughout the length of the overwind in a more economical aspect of assembly. Although there were initial concerns that the gap and extra volume would impact performance of the lamp, initial testing indicates that an insubstantial incremental amount of initial dose is required.

Where the prior art design of FIG. 2 typically calls for a 0% to 1% gap, i.e., to have the turns as tight as possible in which most of the adjacent turns touch each other, the provision of a gap greater than about ten percent (10%), and preferably from approximately a ten percent (10%) gap up to a fifty percent (50%) gap, and the associated lamp performance data for ten percent (10%) to thirty percent (30%) gap, demonstrate that no substantial degradation in performance results. One skilled in the art will realize that it is still desired to limit the amount of overwind that is sealed by the glass frit because of the coefficient of thermal expansion issue. Thus, it is likely that only approximately only 1-2 mm of the molybdenum portion of the electrode assembly adjacent the niobium mandrel will be covered in the seal frit.

Figure 4:
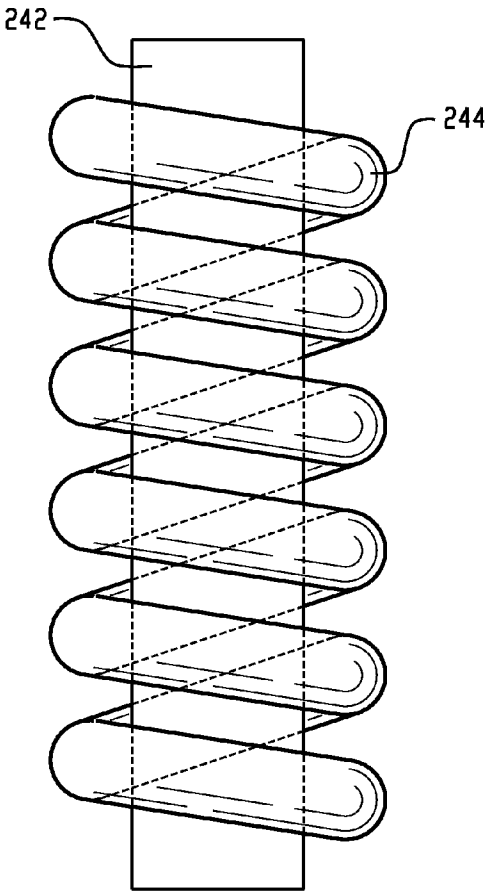
FIG. 4 is a view similar to FIG. 3 of another exemplary embodiment of the present disclosure.

Turning to FIG. 4, the molybdenum mandrel is now referred to by reference numeral 242, while the overwind is represented by reference numeral 244. Here, an even larger space or gap, on the order of fifty percent (50%), between adjacent coils of the overwind is provided. By providing limited coverage of the seal frit at the end of the molybdenum portion of the electrode assembly adjacent the niobium, there is only a limited impact of any potential thermal expansion mismatch between the molybdenum and the ceramic. Likewise, the seal and molybdenum provide desired protection for the niobium from the deleterious effect of the halide dose that would otherwise adversely react with the niobium. Over time, the dose eventually diffuses through the seal glass and can become an end of lifemechanism. However, careful control of the seal length on the molybdenum eliminates failures due to stress from the thermal expansion mismatch. This disclosure also desires to fill the interstitial space of the molybdenum overwind to promote longer lamp life by better protecting the niobium.

This disclosure also contemplates that the ratio of the molybdenum mandrel diameter to the diameter of the molybdenum overwind is greater than approximately 1:1, and preferably will range between approximately 1:1 to 5:1. A standard ratio is approximately 3:1, since the interstitial space is more likely to be filled with the seal frit, opening the pitch now assures that the overwind and mandrel portions of the intermediate component are sealed.

As part of the manufacturing process, niobium wire is purchased, straightened, and cut to length. Molybdenum wire for the overwind and molybdenum wire for the shank are then wound together in a continuous piece and then likewise cut to length. The second portion of the electrode assembly or the molybdenum composite is then butt welded to the niobium mandrel/shank, while a tungsten mandrel/shank and electrode are butt welded at the other end of the molybdenum composite. The electrode assembly is inserted through the opening in the discharge leg, and a glass seal frit disk is placed on to the leg. The particular location of the electrode assembly is carefully controlled so that the electrode is precisely positioned within the arc discharge chamber and likewise the location of the niobium-molybdenum interface is precisely fit at a desired location in the leg. In this manner, heating and melting of the seal frit about the niobium provides a desired seal. Likewise, a portion of the seal frit extends over approximately 1-2 mm of the molybdenum component adjacent the niobium shank and provides the desired protection of the niobium from the halide dose as described above.

By increasing the gap between the molybdenum turns the probability of having seal voids is reduced and likewise the amounts of such voids are decreased. Introducing wider gaps between the molybdenum coils offers a robust solution to the problem. By increasing the gap between the molybdenum turns, the melted frit can flow into the voids more easily. Electrodes having molybdenum having lower turns per inch proved effective in eliminating seal voids both for high watt (150 W to 400 W), as well as low watt (39 W to 70 W), CMH lamps. By eliminating seal voids in the ceramic leg of the arc tube, the risk of early seal leakage is decreased. Although feasibility trials were conducted on both low watt and high watt lamps as noted, these particular values should not be deemed to overly restrict the present disclosure.

Figure 5:
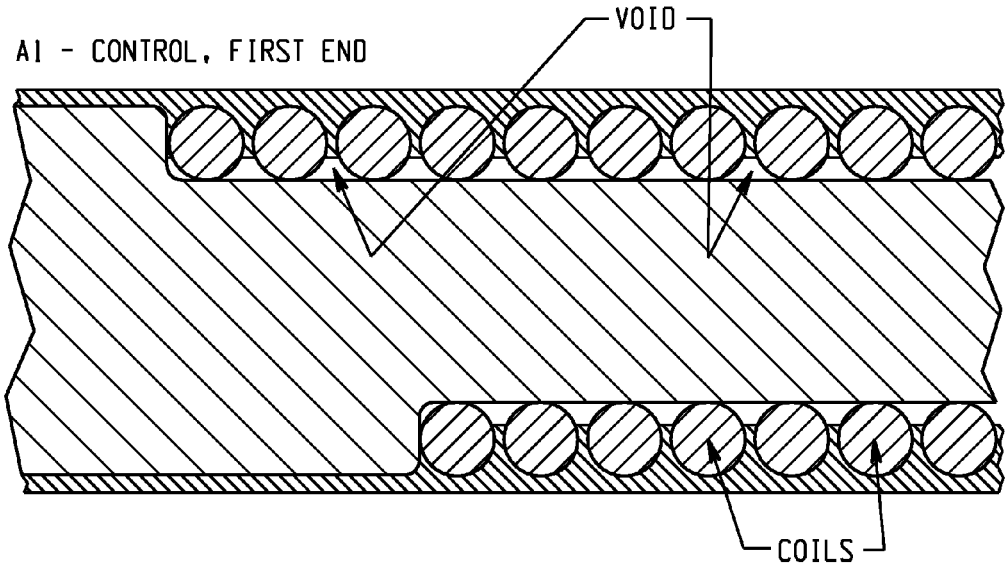
FIG. 5 is an image showing seal voids in a lamp assembly.
Figure 6:
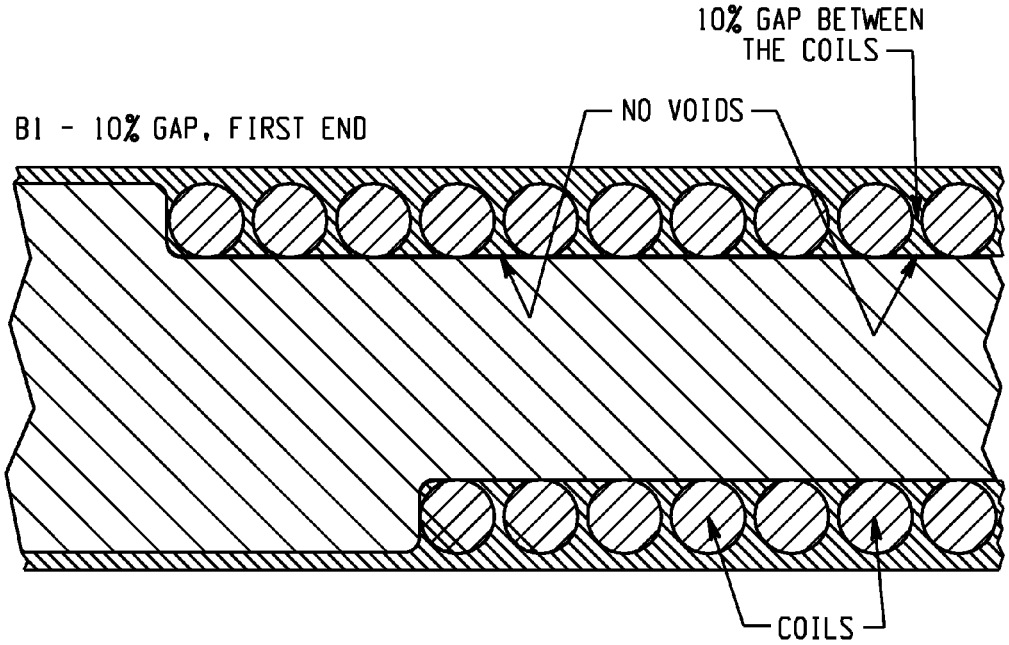
FIG. 6 is an image similar to FIG. 5 and showing the reduction or elimination of seal voids along a portion of the length of the molybdenum mandrel/overwind.

A comparison of FIGS. 5 and 6 particularly illustrates the reduction or elimination of seal voids along at least a portion of the molybdenum mandrel and overwind. More particularly, FIG. 5 shows an undesirable number of seal voids located in a region bordered along the outer diameter of the molybdenum mandrel and along the inner diameter of the molybdenum overwind at an axial location adjacent the niobium shank. Such seal voids are not desired for the reasons noted above, and are particularly undesirable where the seal voids are found in a major portion of the seal glass that extends over the molybdenum mandrel and overwind because the potential for the halide dose to reach the niobium is consequently increased. Thus, there are in essence three regions. A first region is provided at the left-hand end where the frit seal is received over the niobium shank. A second region is generally formed at the right-hand end by the molybdenum mandrel and overwind, and a third region is generally located in between the first and second regions where the frit seal covers the niobium/molybdenum weld and extends over a limited or minimal length of the halide resistant or molybdenum component (mandrel and overwind) that serves as a halide dose resistant section. FIG. 6, on the other hand, illustrates a reduction or elimination of seal voids along a greater extent of the seal glass in the third region that extends over the molybdenum mandrel and overwind. The reduced percentage of seal voids is realized in those arrangements that have an overwind with a lower number of turns per inch (i.e, where the adjacent turns of the overwind are spaced apart) to facilitate receipt of the frit seal on the molybdenum mandrel and beneath the overwind.

The disclosure has been described with reference to the preferred embodiments. Obviously, modifications and alterations will occur to others upon reading and understanding the preceding detailed description. It is intended that the disclosure be construed as including all such modifications and alterations.

What is claimed is:

1. An electrode assembly for a discharge lamp comprising:

a first portion having a first coefficient of thermal expansion (CTE) and that is subject to attack by a dose of the lamp;

a second portion having first and second ends formed of a material different than the first portion, the second portion having a second CTE different than the first CTE and the second portion being more resistant to attack by the dose than the first portion;

an electrode connected to the second end of the section portion; and a helical overwind received over the second portion, wherein adjacent turns of the overwind are spaced apart to form a gap that facilitates receipt of associated seal material in reaching an interstitial space between the overwind and second portion, wherein the helical overwind gap measured between adjacent turns of the overwind is approximately 10% to 50% of a diameter of the overwind.

2. The electrode assembly of claim 1 wherein the gap is between 20% to 30% of the diameter of the overwind.

3. The electrode assembly of claim 1 wherein the first portion is formed from niobium.

4. The electrode assembly of claim 1 wherein the second portion is formed from molybdenum.

5. The electrode assembly of claim 4 wherein the helical overwind is formed from molybdenum.

6. The electrode assembly of claim 1 wherein the helical overwind is formed from molybdenum.

7. A ceramic metal halide (CMH) discharge lamp comprising:

a ceramic body having a discharge chamber and at least one leg having an opening therethrough in communication with the discharge chamber;

an electrode assembly received at least in part in the body wherein the assembly includes a niobium mandrel, a molybdenum mandrel, a tungsten portion, and a molybdenum overwind received over the molybdenum mandrel, wherein adjacent turns of the overwind are spaced by a gap measured between adjacent turns of the overwind that is approximately 10% to 50% of a diameter of the overwind; and at least a first seal extending over at least a portion of the niobium mandrel and over a limited portion of the overwind and molybdenum mandrel.

8. The CMH discharge lamp of claim 7 wherein the gap is approximately 20% to 30%.

9. The CMH discharge lamp of claim 7 wherein a diameter of the molybdenum mandrel ranges from approximately one to five times a diameter of the molybdenum overwind (1:1 to 5:1).

10. The CMH discharge lamp of claim 7 wherein a diameter of the molybdenum mandrel is approximately three times a diameter of the overwind (3:1).

11. The CMH discharge lamp of claim 7 wherein the lamp is between 35 watts and 400 watts.

12. The CMH discharge lamp of claim 7 wherein the at least first seal extends over approximately one to two millimeters (1-2 mm) of the molybdenum mandrel.

13. The CMH discharge lamp of claim 7 wherein a gap (G) between adjacent windings of the overwind is greater than 5μ.

14. The CMH discharge lamp of claim 13 wherein a gap to diameter (D) of overwind ratio (G/D) is greater than 0.05.

15. A method of manufacturing an electrode assembly for a discharge lamp comprising:

supplying a halide resistant mandrel and overwind joined at a first end to a mandrel and joined to an electrode portion at a second end; and providing a gap between adjacent turns of the halide resistant overwind in a region of the overwind encompassing the halide resistant mandrel to receive a seal frit on the turns and the halide resistant mandrel wherein the gap is about 10% to 50% of a diameter of the overwind.

16. The method of claim 15 wherein the gap is greater than 5μ.

17. The method of claim 15 wherein a ratio of a diameter of the halide resistant mandrel to a diameter of the overwind is greater than about 1:1.

* * * * *